US006906691B2

(12) United States Patent
Park et al.

(10) Patent No.: US 6,906,691 B2
(45) Date of Patent: Jun. 14, 2005

(54) LCD DEVICE AND A METHOD FOR REDUCING FLICKERS

(75) Inventors: Haeng-Won Park, Sungnam-shi (KR); Man-Bok Cheon, Yongin-shi (KR); Keun-Shik Nah, Inchum-shi (KR)

(73) Assignee: Samsung Electronics Co., Ltd., Suwon (CN)

( * ) Notice: Subject to any disclaimer, the term of this patent is extended or adjusted under 35 U.S.C. 154(b) by 257 days.

(21) Appl. No.: 09/955,084

(22) Filed: Sep. 19, 2001

(65) Prior Publication Data

US 2002/0080127 A1 Jun. 27, 2002

(30) Foreign Application Priority Data

Dec. 26, 2000 (KR) ..... 2000-82004

(51) Int. Cl.[7] ..... G09G 3/36
(52) U.S. Cl. ..... 345/89
(58) Field of Search ..... 345/87, 89, 92, 345/98, 99, 100, 204, 690, 699, 77, 102, 144, 214, 90, 1 W, 211, 147; 349/61, 62

(56) References Cited

U.S. PATENT DOCUMENTS 6,111,559 A * 8/2000 Motomura et al. ..... 345/102
6,219,016 B1 * 4/2001 Lee ..... 345/87
6,556,180 B1 * 4/2003 Furuhashi et al. ..... 345/87
2001/0020925 A1 * 9/2001 Hattori et al. ..... 345/87
2003/0030604 A1 * 2/2003 Moon et al. ..... 345/87

* cited by examiner

*Primary Examiner*—Amare Mengistu
*Assistant Examiner*—Nitin Patel
(74) *Attorney, Agent, or Firm*—McGuireWoods LLP

(57) ABSTRACT

An LCD device includes a timing control circuit having a flicker reducing portion for detecting flickers in the entire one frame to be displayed in a liquid crystal panel and controlling a brightness of the backlight according to an amount of detected flickers. The timing control circuit can evidently reduce visually recognized flickers by dimming the brightness of the backlight when the detected flickers is more than given rate.

16 Claims, 4 Drawing Sheets

LCD DEVICE AND A METHOD FOR REDUCING FLICKERS

FIELD OF THE INVENTION

The present invention relates to a liquid crystal display (LCD) device, and more particularly to an active matrix type LCD device of using thin film transistors (TFT) as switching elements and a method for reducing flickers.

BACKGROUND OF THE INVENTION

In an active matrix type LCD device, all pixels are driven by a plurality of active elements having non-liner characteristics, each of which is disposed in each of pixels arranged in matrix shape. As the active elements, TFT elements are generally used.

In the LCD device, optical display characteristics are dependent on TFT elements, liquid crystal material, cell gaps, color filters and the like. Accordingly, as the TFT LCD device is used for a long time, flickers or image stickings deteriorating display characteristic may occur.

To reduce flickers, various methods have been proposed. Examples of the conventional methods of reducing flickers are disclosed in U.S. Pat. No. 5,253,091 issued to Kimura et al., on October, 1993 and entitled Liquid Crystal Display Having Reduced Flickers," and U.S. Pat. No. 5,436,747 issued to Suzuki et al., on July, 1995 and entitled "Reduced Flicker Liquid Crystal Display."

A general LCD device includes a TFT substrate having a plurality of pixel electrodes and TFT elements, an opposite color filter substrate having common electrodes and color filters, and a liquid crystal material therebetween.

In the LCD device, a plurality of TFT elements, each of which is disposed in a pixel, supply voltage to the common electrodes formed on the color filter substrate and the pixel electrodes formed on the TFT substrate to control electric fields which are to be applied to the liquid crystal. When the pixel electrodes and the common electrodes are applied with voltages by the operation of the corresponding TFT elements, the molecules of the liquid crystal material change their orientations in response to the electric fields due to the potential difference between the pixel electrodes and the common electrodes. At this time, the electric field between two electrodes is generally controlled to periodically change its direction.

For example, signal voltage supplied to the pixel electrodes through the TFT elements is periodically inverted with respect to common electrode voltage supplied to the common electrodes. At this time, if actual values of inverted signal voltages of positive and negative against the common electrode voltage are same, flickers and afterimages or image stickings do not occur. However, if the virtual values of the positive and negative voltages are different from each other, electric fields having elements of direct current may be applied between two electrodes to generate image stickings. Also, if positive and negative voltages to same gray scale are not symmetrical to each other with respect to the common electrode voltage, brightness of each pixel may come to be different according to each of the positive and negative voltages and thereby flickers occur. Even though at first the common electrode voltage has been correctly modulated not to impose the elements of direct current and the like, components of the LCD device such as the TFT elements, color filters, and a protecting sheet physically change as it is used. Accordingly, the common electrode voltage may be deviated from optimum condition and thereby increase flickers. Particularly, a large size LCD of a high definition may exponentially increase an amount of visually recognized flickers.

SUMMARY OF THE INVENTION

It is an object of the present invention to provide an improved LCD device and a method for reducing flickers.

This and other objects are provided, according to the present invention, by an LCD device comprising a liquid crystal panel having a plurality of pixels, a backlight for supplying light having an uniform brightness to the liquid crystal panel, a timing control circuit for generating gate clock signal and a plurality of control signals, a gray scale voltage generating circuit for generating a plurality of gray scale voltages corresponding to data to be displayed in the liquid crystal panel in response to the gate clock signal, a gate driving circuit for scanning the pixels of the liquid crystal panel row by row in response to the gate clock signal, and a source driving circuit for outputting liquid crystal driving voltage to the liquid crystal panel every scanning. The timing control circuit senses whether or not data to be displayed in the liquid crystal panel is toggled, and generates control signals for controlling brightness of the backlight according to sensed results.

According to another aspect of the present invention, there is provided a method for reducing flickers comprising the steps of inputting data in a timing controller of an LCD device, detecting whether or not inputted data is toggled, counting the number of toggled data among data in one line to be displayed in the LCD device, counting the number of toggled line among data of one frame to be displayed in the LCD device, and controlling a brightness of the LCD device in response to the number of toggled line.

DETAILED DESCRIPTION OF PREFERRED EMBODIMENTS

The present invention now will be described more fully hereinafter with reference to the accompanying drawings, in which preferred embodiment of the invention is shown. This invention may, however, be embodied in many different forms and should not be construed as limited to the embodiment set forth herein. Like numbers refer to like elements throughout.

An LCD device in accordance with the present invention includes a timing control circuit having a flicker reducing portion for detecting an amount of flickers included in one entire frame to be displayed in a liquid crystal panel and controlling a brightness of the backlight according to an amount of detected flickers. The timing control circuit can evidently reduce an amount of visually recognized flickers by generating control signal to dim the backlight brightness when the detected flickers are more than allowed.

Figure 1:
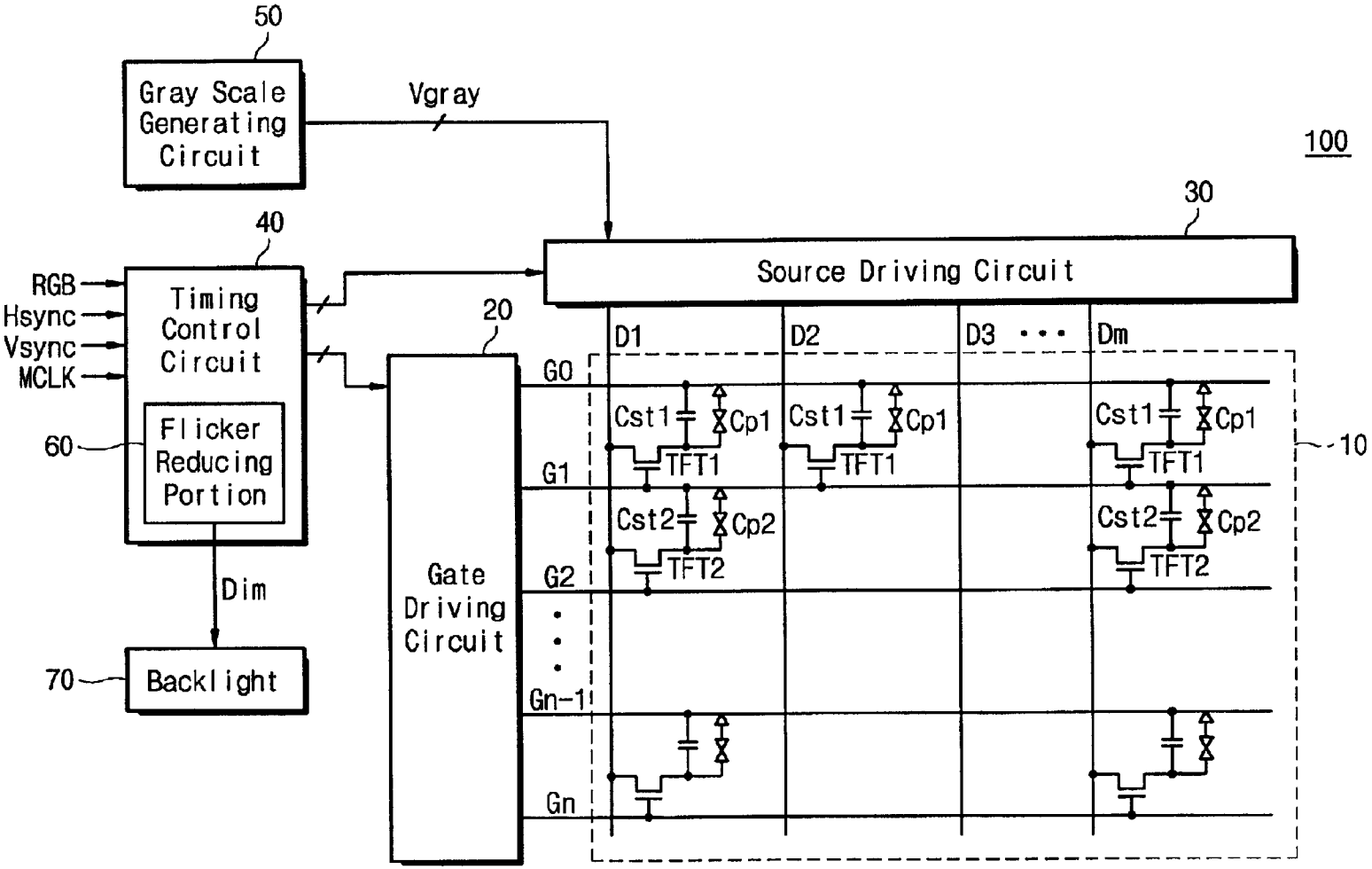
FIG. 1 is a block diagram of a LCD device in accordance with the present invention.

FIG. 1 is a block diagram of a LCD device 100 in accordance of the present invention.

Referring now to FIG. 1, the LCD device 100 includes a liquid crystal panel 10, a gate driving circuit 20 coupled to the liquid crystal panel 10, a source driving circuit 30, a timing control circuit 40 having a flicker reducing portion 60, a gray scale voltage generating circuit 50, and a backlight 70.

The liquid crystal panel 10 comprises a plurality of gate lines G0–Gn, and a plurality of data lines D1–Dm crossing the gate lines G0–Gn, respectively. Each gate line is coupled to a gate driving circuit 20 and each data line coupled to a source driving circuit 30. The liquid crystal panel 10 displays pure red, pure green, pure blue and gray levels or scales as well as color pictures by combining three kinds of color filters of red R, green G, and blue B. The backlight 70 is coupled to the liquid crystal panel 10 to provide plane light having an uniform brightness. The gray scale voltage generating circuit 50 is coupled to the source driving circuit 30 to generate standard voltages Vgray for providing standards in generating liquid crystal driving voltages. The gate driving circuit 20 scans pixels of the liquid crystal panel 10 one row at a time in order. When the gate driving circuit 20 scans the pixels of the liquid crystal panel 10, the source driving circuit 30 generates the liquid crystal driving voltages according to color signals RGB inputted through the timing control circuit 40 in response to the standard voltages Vgray outputted from the gray scale voltage generating circuit 50, and outputs generated liquid crystal driving voltages to the liquid crystal panel 10 every scanning.

The timing control circuit 40 generates control signals necessary to the gate driving circuit 20 and the source driving circuit 30 in response to color signals RGB, line distinction signals H_Sync, frame distinction signals V_Sync, and clock signals MCLK. Also, the timing control circuit 40 detects flickers included in the color signals RGB through the flicker reducing portion 60, and reduces the visually recognized flickers displayed on the liquid crystal panel 10 by controlling the panel brightness depending on the amount of detected flickers.

Generally, recognizing flickers is different according to individuals and their existing condition. Accordingly, in some LCD technique fields, attempts have been made to measure flickers by a psychophysiology or psychological method. For example, the older has the less sensitivity on flickers. Also, the sensitivity on flickers is reduced according to fatigue degree. Thus, flickers are differently felt according to visual sensitivity, i.e., they are easily sensed when illumination is high, but scarcely sensed when illumination is low. By using this characteristic of flickers, the timing control circuit 40 of the present invention controls the picture brightness to make flickers scarcely sensed when flickers are more than given level, whereas to return the normal brightness level when flickers is below the level.

Figure 2:
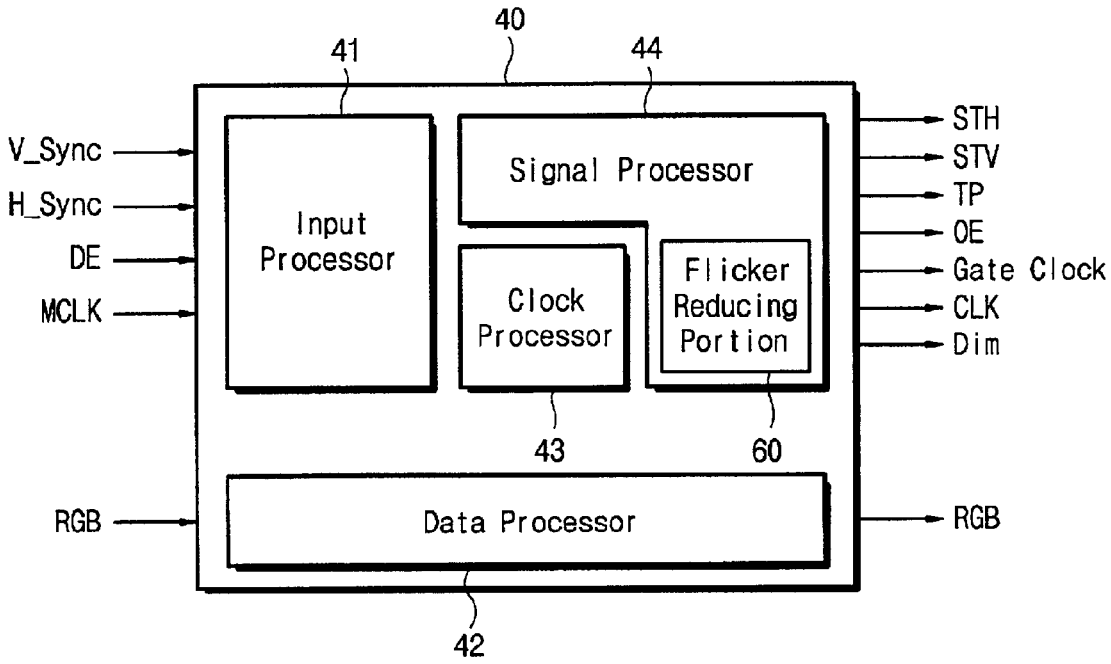
FIG. 2 is a block diagram of a timing control circuit of the LCD device shown in FIG. 1.

Here will be explained the structure or composition of the timing control circuit 40 operated as described above with reference to FIG. 2. FIG. 2 is a block diagram of the timing control circuit 40 of the LCD device 100 shown in FIG. 1. Referring to FIG. 2, the timing control circuit 40 greatly comprises an input processor 41, a data processor 42, a clock processor 43 and a signal processor 44. The signal processor 44 includes a flicker reducing portion 60 for controlling the brightness of the liquid crystal panel 10 according to the amount of flickers.

The data processor 42 and the clock processor 43 control timings of the color signals RGB and clock signals MCLK, respectively. The signal processor 44 generates control signals necessary to the gate driving circuit 2 and the source driving circuit 3, for example start horizontal signal STH, start vertical signal STV, load signal TP, gate clock signal Gate Clock, gate on enabling signal OE and the like in response to the frame distinction signal V_Sync and the line distinction signal H_Sync inputted from a graphic controller (not shown), DE signal showing high level only in outputting of the color signals RGB, and the clock signal MCLK. The input processor 41 transforms variable signals coming from the graphic controller into given signals, and thereby to operate the data processor 42 and the signal processor 44. The flicker reducing portion 60 disposed in the timing control circuit 40 senses an amount of flickers in the whole of one frame displayed in the liquid crystal panel 10, and generates control signals Dim for controlling a brightness of the liquid crystal panel 10 according to an amount of sensed flickers. The backlight 70 includes a dimming circuit (not shown) to control a brightness of the backlight 70 in response to the control signals Dim generated from the timing control circuit 40. This kind of dimming circuit of the backlight 70 is disclosed in the U.S. Pat. No. 5,939,830 issued to Praiswater on August, 1999 and entitled "Method And Apparatus For Dimming A Lamp In A Backlight Of A Liquid Crystal Display."

Figure 3:
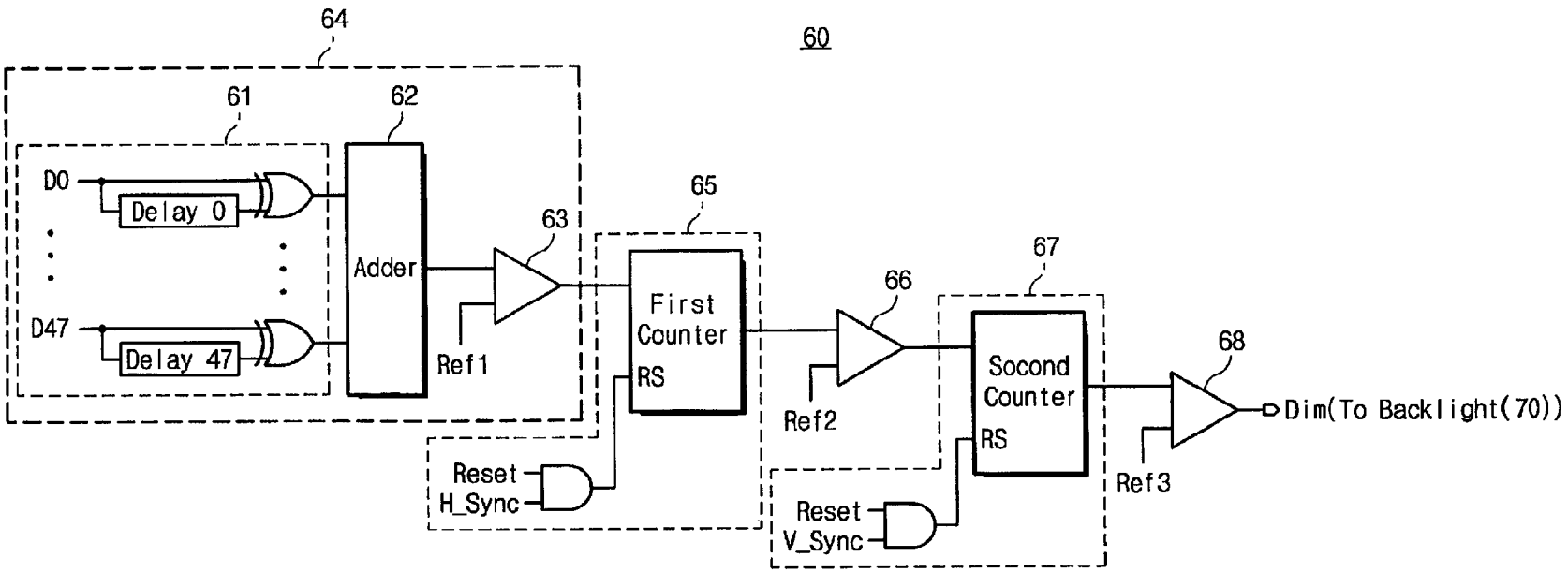
FIG. 3 is a circuit diagram of a flicker reducing portion of the LCD device shown in FIG. 2.

FIG. 3 is a circuit diagram of the flicker reducing portion 60 of the LCD device 100 in accordance with a preferred embodiment of the present invention. Referring to FIG. 3, the flicker reducing portion 60 of the present invention comprises a flicker sensing portion 64 having a toggling detector 61, an adder 62 and a first comparator 63, a first counter 65, a second comparator 66, a second counter 67, and a third comparator 68. It should be noted that a first reference value Ref1, a second reference value Ref2 and a third reference value Ref3, inputted in the first comparator 63, the second comparator 66 and the third comparator 68 can vary according to the resolution and driving method of the LCD device 100. In the present invention, they are explained as applied to a super extended graphics array (SXGA) having a resolution of 1280*1024 and a dual port driving method that can concurrently input odd pixel data and even pixel data.

In order to sense whether or not inputted color signal RGB has a flicker, the toggling detector 61 of the flicker sensing portion 64 detects whether or not each of bits forming the color signal RGB is toggled. For this, the toggling detector 61 receives the color signal RGB with dividing them into each of bits D0–D47, delays received bits D1–D47 through delays Delay0–Delay47 for a given time and then performs XOR operation to each of delayed bits and non-delayed original bits. When the received bit is toggled, a result of the XOR operation comes to "1", whereas when the received bit is not toggled, a result of the XOR operation comes to "0". These results of the XOR operation are inputted to the adder 62 to be added. The adder 62 calculates the number of toggled bits among inputted color signal RGB. The first comparator 63 compares the number of toggled bits calculated through the adder 62 with a first standard value Ref1. According to the results of the first comparator 63, a result having value of "0" or "1" is inputted to the first counter 65. At this time, the first standard value Ref1 is set based on the number of bits in data inputted at a time. For example, when a color signal RGB composed of 8 bits is inputted, each of signals composed of red R, green G and blue B needs data of 8 bits, so that the number of bits necessary to show one pixel comes to 8*3, i.e., 24. Particularly, in case of the dual port driving method which at the present time, is widely used, since odd pixel data and even pixel data are concurrently inputted, the number of bits in data inputted at a time comes to 8*3*2, i.e., 48.

The flicker sensing portion 64 senses whether or not inputted data have flickersby detecting whether or not each of bits D0–D47 forming the inputted data is toggled. The reason is that flickers are generated in a shape of toggled data. Also, the flicker sensing portion 64 outputs a value of "1" showing that the inputted data have flickers when all the bits D0–D47 forming the inputted data are toggled, and otherwise a value of "0".

Once the flicker sensing portion 64 senses whether or not the inputted data have a flicker, a sensed result having a value of "0" or "1" is inputted to the first counter 65. The first counter 65 as a pixel toggler composed of 10 bit counter receives reset signal Reset and line distinction signal H_Sync as well as the sensed result through AND gate. Namely, the first counter 65 counts the number of inputted data generating flickers, in pixel unit, in response to the sensed result received from the flicker sensing portion 64. When the line distinction signal H_Sync is input the first counter 65 outputs only the number of flickers generated in one line and is reset. Thus, the number of pixels with a flicker in one line is detected.

When the number of flickers generated in one line is counted by the first counter 65, a counted result, i.e., a first count value is compared with a second standard value Ref2 through the second comparator 66. It should be noted that the second standard value Ref2 means the number of pixels in one line. For example, in case the LCD device 100 employs the dual port driving method and has a resolution of 1280*1024 such as SXGA, the second standard value Ref2 becomes 640. The second comparator 66 detects whether or not the counted result, i.e., the first count value is the same as the second standard value Ref2. As a result, if the counted result is the same as the second standard value Ref2, the second comparator 66 outputs "1" and otherwise, outputs "0". Thus, the second comparator 66 detects whether or not flickers are generated in the entire one line.

Once the first counter 65 and the second comparator 66 detect whether or not flickers are generated in the entire one line, a detected result of each line having a value of "1" or "0" is inputted to the second counter 67. The second counter 67, a pixel toggler composed of 10 bit counter, receives reset signal Reset and line distinction signal V_Sync as well as the detected result, i.e., the number of detected flickers through AND gate. Namely, the second counter 67 counts the number of detected flickers on each line outputted from the second comparator 66. Upon inputting of the frame distinction signal V_Sync, the second counter 67 outputs the number of flickered lines in one frame and is reset. Thus, the number of flickered lines in one frame is obtained.

When the number of lines having a flicker in one frame is counted by the second counter 67, a counted result, i.e., a second count value is compared with a third standard value Ref3 through the third comparator 68. Here should be noted that the third standard value Ref3 means a value which the number of lines forming one frame is multiplied by a given rate. For example, in SXGA having a resolution of 1280*1024, the third standard value Ref3 comes to a value corresponding to about 90% of 1024, i.e., 921. The reason of setting like this is to reduce the amount of visually recognized flickers by dimming the brightness of the backlight 70 when flickers are generated at more than 90% of pixels in one frame. For this, the third comparator 68 compares the counted result, i.e., the second count value with the third standard value Ref3. As a result, if the counted result is the same as or larger than the third standard value Ref3, the third comparator 68 outputs a control signal Dim having a value of "1" to the backlight 70 to control the brightness thereof to be dimmed and otherwise, generates a control signal Dim having a value of "0" to the backlight 70.

The flicker reducing portion 60 of the present invention operating as described above is characterized to have simple circuit components such as counters and comparators without separate memories. Thus, it occupies only a small amount of circuit area and thereby reduces its fabrication cost.

As described above, the timing control circuit 40 of the present invention detects whether or not a flicker is generated in each pixel of one frame, and generates the control signal Dim for controlling the brightness of the backlight 70 by dimming when flickers are generated above a given level. On the other hand, when the backlight 70 is dimmed by the timing control circuit 40, the timing control circuit 40 generates a control signal Dim that restores the brightness of the backlight 70, if the flicker level falls below the given level. This can reduce the visually recognized flickers. At this time, brightness control standard for the backlight 70 can be obtained by modulating the standard values Ref1–Ref3 properly. Also, brightness control levels for the backlight 70 can be controlled by modulating the standard values Ref1–Ref3 properly.

Figure 4:
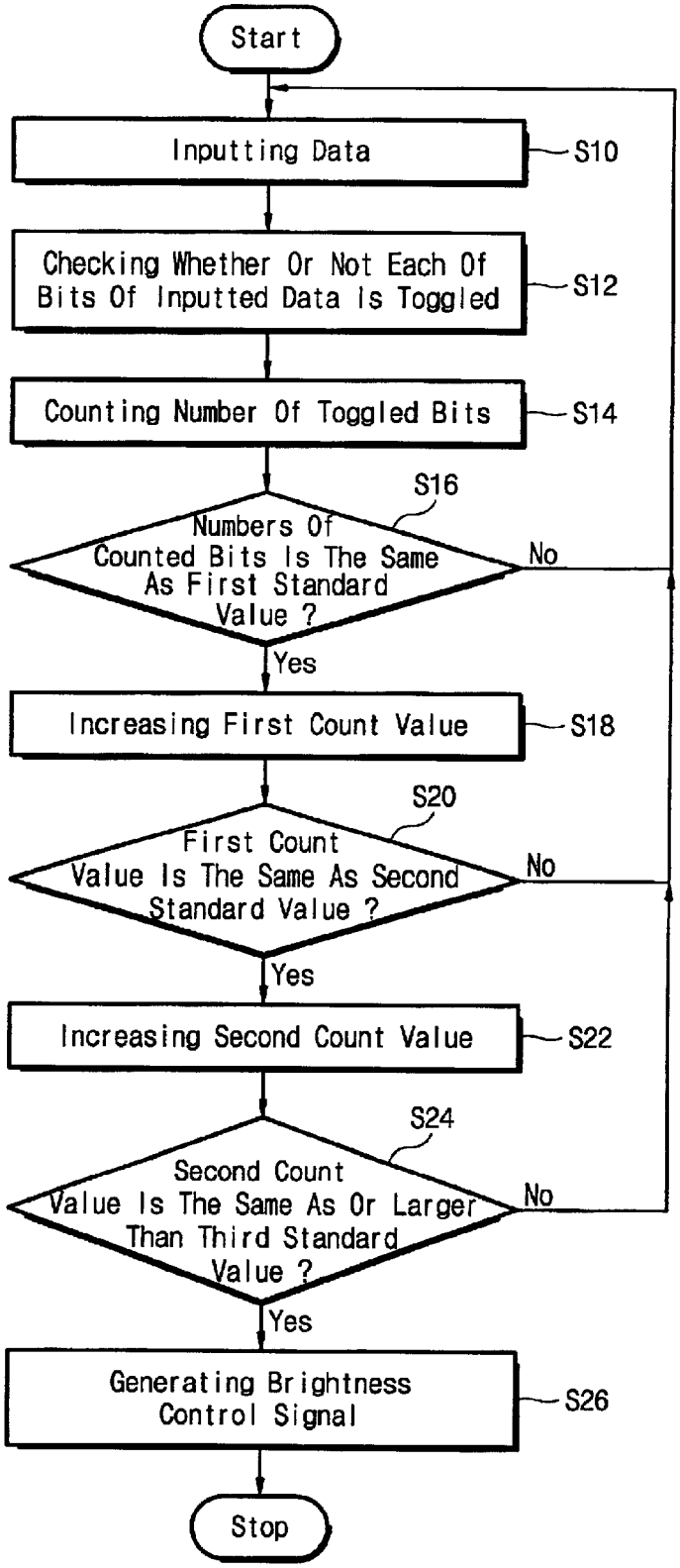
FIG. 4 is a flow chart showing the process steps of a method for reducing flickers in accordance with the present invention.

FIG. 4 is a flow chart showing steps of the method for reducing flicker level in an LCD device in accordance with a preferred embodiment of the present invention. Particularly, FIG. 4 shows the operation steps of the flicker reducing portion 60 shown in FIG. 3.

Referring to FIG. 4, first, color signal RGB corresponding to each pixel of the LCD device is inputted (S10). Then, each of bits forming inputted color signal RGB is checked whether or not it is toggled (S12). And then, the number of toggled bits is counted (S14). Thereafter, the number of counted bits is checked whether or not it is the same as a first standard value Ref1 (S16). Here should be noted that the first standard value Ref1 means the number of the entire bits of the color signal RGB inputted at a time. In case of a LCD device complying with a dual port driving method and having a resolution of 1280*1024 such as SXGA, the first standard value Ref1 is 48.

At the step S16, when the number of counted bits is the same as the first standard value Ref1, a first count value is increased (S18), and otherwise the operation step is returned to the first step S10 to repeat the operations as described above. Here, it should be noted that the fact that the number of counted bits is the same as the first standard value Ref1 means that all the bits of inputted color signal RGB are toggled to generate flickers, and the first count value means the number of toggled pixels, i.e., flickered pixels in one line.

Next, the first count value is compared with a second standard value Ref2 to detect whether or not they are same each other (S20). Here should be noted that the second standard value Ref2 means the number of pixels forming one line. In case of the LCD device complying with the dual port driving method and having a resolution of 1280*1024 such as SXGA, the second standard value Ref2 is 640. At the step S20, when the first count value is the same as the second standard value Ref2, i.e., when flickers are generated in the entire one line, a second count value is increased (S22), and otherwise the operation step is returned to the first step S10 to repeat the operations as described above. It should be noted that the second count value means the number of toggled lines, i.e., flickered lines in one frame.

Then, the second count value is checked whether or not it is the same as a third standard value Ref3 (S24). Here, it should be noted that the third standard value Ref3 means a value which the number of lines forming one frame is multiplied by a given rate, for example about 90%. In case of the LCD device complying with the dual port driving method and having a resolution of 1280*1024 such as SXGA and the given rate being 90%, the third standard value Ref3 is 90% of 1024, or 921. At the step S24, when the second count value is the same as or larger than the third standard value Ref3, i.e., when flickers are generated above a given rate, for example about 90% in the entire one frame, a control signal Dim that dims a backlight 70 is generated (S26). Otherwise, the operation step returns back to the first step S10 to repeat the operations as described above.

FIG. 4 shows that when flickers are generated above the given rate in the whole of one frame, the control signal Dim is generated to dim the brightness of the backlight 70. However, on the other hand, when flickers are generated below the given rate in the entire frame but the brightness of the backlight 70 is dimmed, the timing control circuit 40 of the present invention can also restore the brightness of the backlight 70. Also, in the method of the present invention, brightness control standard for controlling the brightness of the backlight 70 can be changed by modulating the standard values Ref1–Ref3 properly. Also, it is possible to control brightness levels of the backlight 70 at more than one level.

As apparent from the foregoing description, it can be appreciated that the present invention provides an LCD device and a method for reducing flickers, which can evidently reduce the visually recognized flickers by a simple circuit composition.

In the drawings and specification, there has been disclosed typical preferred embodiment of the invention and, although specific terms are employed, they are used in a generic and descriptive sense only and not for purpose of limitation, the scope of the invention being set forth in the following claims.

What is claimed is:

1. An LCD device, comprising:

a liquid crystal panel having a plurality of pixels;

a backlight for supplying light;

a timing control circuit for generating a gate clock signal and a plurality of control signals, sensing whether or not data to be displayed in said liquid crystal panel is toggled, and generating a control signal for controlling a brightness of said backlight according to sensed results;

a gray scale voltage generating circuit for generating a plurality of gray scale voltages corresponding to said data to be displayed in said liquid crystal panel in response to said gate clock signal;

a gate driving circuit for scanning the pixels of said liquid crystal panel a row at a time in order, in response to the gate clock signal; and a source driving circuit for generating liquid crystal driving voltages corresponding to the data to be displayed in said liquid crystal panel in response to the gray scale voltages and the control signals, and outputting generated liquid crystal driving voltages to said liquid crystal panel.

2. The LCD device according to claim 1, wherein said timing control circuit comprises:

a signal generating unit for generating the gate clock signal and the control signals; and a flicker reducing unit for reducing visually recognized flickers by detecting a number of toggled data included in data of one frame to be displayed in said liquid crystal panel and controlling brightness of said backlight according to the detected number of toggled data.

3. The LCD device according to claim 2, wherein said flicker reducing unit comprises:

a flicker sensing portion for sensing in pixel unit whether or not said data is flickered by detecting whether or not said data is toggled;

a first counter for counting the number of toggled data among data displayed in one line of said liquid crystal panel according to said flicker sensing portion;

a first comparator for detecting whether or not the entire data in the line is toggled by comparing the results from said first counter with a first standard value;

a second counter for counting a number of lines where the entire data is toggled, according to the results detected by said first comparator; and a second comparator for comparing the results from said second counter with a second standard value, and generating the control signal to dim the backlight when results from said second counter is the same as or higher than a second standard value.

4. The LCD device according to claim 3, wherein said flicker sensing portion comprises:

a toggling detector for detecting whether or not each of bits in the data is toggled by receiving said bits, delaying received bits for a given time period and performing XOR operation to each of delayed and non-delayed bits;

an adder for counting the number of toggled bits among said bits forming said data in response to the results of said XOR operation to each of said bits generated from said toggling detector; and a third comparator for detecting whether the data is toggled by comparing the number of toggled bits with a third standard value.

5. The LCD device according to claim 3, wherein said flicker reducing unit generates a control signal to restore the brightness of the backlight when the number of toggled data included in one frame is below the second standard value.

6. The LCD device according to claim 5, wherein said flicker reducing unit can control the brightness of the backlight at more than one level.

7. A method for reducing flickers in an LCD device, comprising the steps of:

inputting data into a timing controller of the LCD device;

detecting whether or not inputted data is toggled;

counting the number of toggled data in a line to be displayed in the LCD device;

counting the number of toggled lines in a frame to be displayed in the LCD device; and controlling brightness of the LCD device according to the number of toggled lines.

8. The method for reducing flickers according to claim 7, wherein the step of detecting whether or not inputted data is toggled includes:

detecting whether or not each of bits forming the data is toggled by receiving the bits;

delaying received bits for a given time;

performing XOR operation on each of the delayed bits and non-delayed bits;

counting a number of toggled bits using the results of the XOR operation; and comparing the number of toggled bits with a first standard value.

9. The method for reducing flickers according to claim 8, wherein the step of counting the number of toggled data in a line to be displayed in said LCD device includes:

increasing a first count value when the number of toggled bits is the same as the first standard value; and comparing the first count value with a second standard value.

10. The method for reducing flickers according to claim 9, wherein the step of counting the number of toggled lines in a frame to be displayed in the LCD device includes increasing a second count value when the first count value is the same as the second standard value.

11. The method for reducing flickers according to claim 10, wherein the step of controlling brightness of the LCD device according to the number of toggled line includes:

comparing the second count value with a third standard value; and dimming the brightness of the backlight when the second count value is the same as or higher than the third standard value.

12. The method for reducing flickers according to claim 11, wherein the step of controlling brightness of the LCD device according to the number of toggled line further includes restoring the brightness of the backlight when the second count value becomes below the third standard value after dimming the brightness of the backlight.

13. The method for reducing flickers according to claim 12, wherein the brightness of the backlight is set to be controlled at more than one level.

14. A liquid crystal display (LCD) device, comprising:

a liquid crystal panel having a plurality of pixels;

a backlight arranged in the liquid crystal panel;

a means for generating a gate clock signal and a plurality of control signals;

a means for generating a control signal; and a means for reducing flicker in the liquid crystal display which decreases the brightness of the backlight wherein the means for reducing flicker comprises:

a flicker sensing portion;

a first counter in electrical communication with the flicker sensing portion;

a second comparator in electrical communication with the first counter;

a second counter in electrical communication with the second comparator; and a third comparator in electrical communication with the second counter.

15. The liquid crystal display (LCD) device according to claim 14, wherein the flicker sensing portion comprises:

a toggle detector capable of receiving a color signal;

an adder in electrical communication with the toggle detector; and a first comparator in electrical communication with the toggle detector.

16. The liquid crystal display (LCD) device according to claim 15, wherein the third comparator outputs a control signal to the backlight to control a brightness of the backlight.

* * * * *